US006945614B2

(12) United States Patent
Flowers et al.

(10) Patent No.: US 6,945,614 B2
(45) Date of Patent: Sep. 20, 2005

(54) DISHWASHER DOOR HINGE POSITIONING MEANS AND METHOD

(75) Inventors: Christopher L. Flowers, Humboldt, TN (US); Thomas M. Johnson, Jackson, TN (US); Barry E. Tuller, Humboldt, TN (US)

(73) Assignee: Maytag Corporation, Newton, IA (US)

( * ) Notice: Subject to any disclaimer, the term of this patent is extended or adjusted under 35 U.S.C. 154(b) by 287 days.

(21) Appl. No.: 10/171,031

(22) Filed: Jun. 12, 2002

(65) Prior Publication Data

US 2003/0230956 A1 Dec. 18, 2003

(51) Int. Cl.[7] ..... E03C 1/18
(52) U.S. Cl. ..... 312/228
(58) Field of Search ..... 312/228, 228.1, 312/229, 311, 327; 16/221, 249, 254, 270, 319, 360, 374

(56) References Cited

U.S. PATENT DOCUMENTS

| | | | | | |
|---|---|---|---|---|---|
| 2,800,128 | A | * | 7/1957 | Chesser | 126/191 |
| 3,826,553 | A | * | 7/1974 | Cushing et al. | 312/351.3 |
| 3,921,252 | A | * | 11/1975 | Guth | 16/281 |
| 4,021,968 | A | * | 5/1977 | Kendall | 49/386 |
| 4,359,250 | A | | 11/1982 | Jenkins | |
| 4,746,177 | A | | 5/1988 | Lampman et al. | |
| 4,900,109 | A | * | 2/1990 | Boston et al. | 312/276 |
| 4,940,298 | A | | 7/1990 | Jackson et al. | |
| 5,613,747 | A | | 3/1997 | Becker et al. | |
| 5,758,676 | A | | 6/1998 | Duckwall et al. | |
| 5,794,309 | A | * | 8/1998 | Lotz | 16/334 |
| 6,036,292 | A | * | 3/2000 | Mandel et al. | 312/405 |
| 6,045,203 | A | * | 4/2000 | Marks et al. | 312/228 |
| 6,254,173 | B1 | * | 7/2001 | Friedewald et al. | 296/202 |

FOREIGN PATENT DOCUMENTS

| | | | | | |
|---|---|---|---|---|---|
| JP | 409000485 | A | * | 1/1997 | A47L/19/00 |

* cited by examiner

*Primary Examiner*—Leslie A. Braun
*Assistant Examiner*—A. Joseph Wujciak
(74) *Attorney, Agent, or Firm*—McKee, Voorhees & Sease, P.L.C.

(57) ABSTRACT

A dishwasher includes a tub, a frame extending around the tub, and a door pivotally secured to the frame for movement between a vertical closed position and a horizontal open position. Hinges are provided on each side of the door to provide a door pivot axis, and are fixed to the frame of the dishwasher. The hinges are accurately positioned relative to the tub by providing at least one boss on each side of the tub, and a recess or hole in each hinge to receive the boss. The hinges are then secured to the frame with screws or by welding. Thus, the hinges are accurately aligned with one another at the proper location on the frame so as to provide proper sealing between the door and the tub when the door is in the closed position.

11 Claims, 3 Drawing Sheets

DISHWASHER DOOR HINGE POSITIONING MEANS AND METHOD

BACKGROUND OF THE INVENTION

A conventional dishwasher includes a tub defining the washing chamber and a door pivotally mounted for movement between open and closed positions relative to the front opening of the tub. The tub typically is made of plastic. A metal frame is normally provided to support the tub in a position above the floor and to provide structural rigidity for the tub. The hinges for the door are usually welded or otherwise secured to the metal frame.

In manufacturing and assembling a conventional dishwasher, the door hinges are welded to the frame, and the frame with the hinges is then secured to the tub. This manufacturing process increases the stack up of tolerances. Also, this manufacturing process causes the door pivot axis to vary in relationship to the tub, from dishwasher to dishwasher, therefore causing door mounting problems and leaks around the door seal.

Accordingly, a primary objective of the present invention is the provision of an improved dishwasher which overcomes the problems of the prior art.

Another objective of the present invention is the provision of an improved dishwasher wherein the door hinges are quickly, easily, and accurately positioned so as to assure proper pivotal movement of the door and proper sealing of the door with the tub.

A further objective of the present invention is the provision of a method of locating dishwasher door hinges on the dishwasher tub and frame so as to accurately mount the door to the tub.

Still another objective of the present invention is the provision of a method for mounting the door hinges on the frame of the dishwasher.

Another objective of the present invention is the provision of a dishwasher tub having one or more bosses for locating the door hinges for accurate mounting of the hinges to the dishwasher frame.

These and other objectives will become apparent from the following description of the invention.

SUMMARY OF THE INVENTION

An improved dishwasher is provided, with the dishwasher having a tub, a frame extending around the tub, a door, and a pair of hinges secured to the frame on opposite sides of the tub for pivotally connecting the door to the tub. The improvement comprises at least one boss on each side of the tub, and a recess in each hinge adapted to receive the boss so as to locate the hinge relative to the tub and frame. Preferably, two bosses are provided on each side of the tub, with two recesses provided in the hinge, to accommodate both vertical and horizontal positioning of the hinge on the tub. In an alternate construction the hinge includes the bosses or dimples and the tub includes recesses for receiving the bosses.

The method of the present invention involves locating a dishwasher door hinge on the dishwasher tub so as to accurately mount the door to the tub. The method includes positioning an aperture on the hinge over a boss on the tub, and then fixing the hinge to the frame extending around the tub. Alternatively, the method includes positioning a boss on the hinge over a recess or aperture on the tub, and then fixing the hinge to the frame extending around the tub.

DETAILED DESCRIPTION OF THE INVENTION

Figure 1:
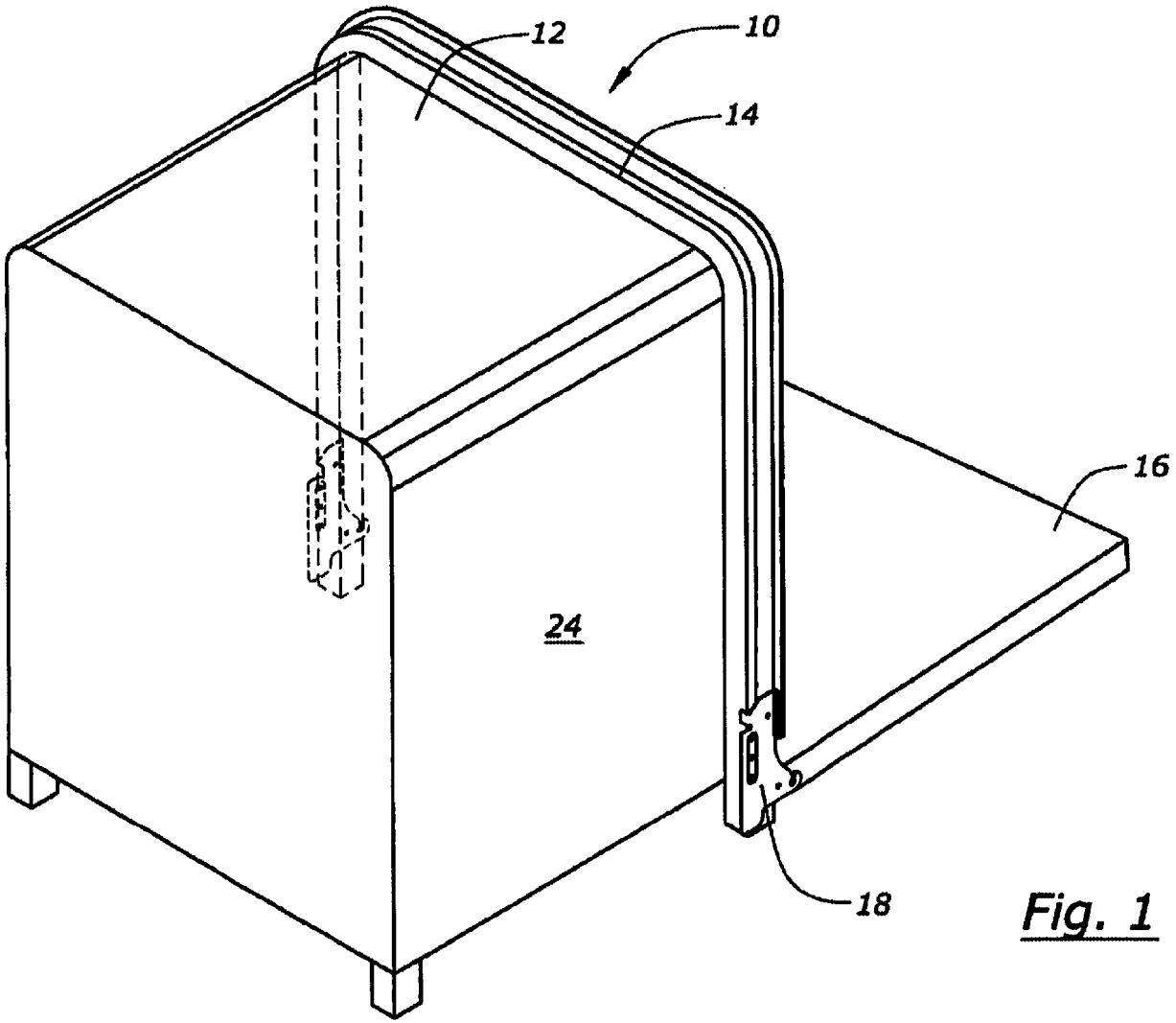
FIG. 1 is a rear perspective view of a dishwasher of the present invention with a door in an open position.
Figure 2:
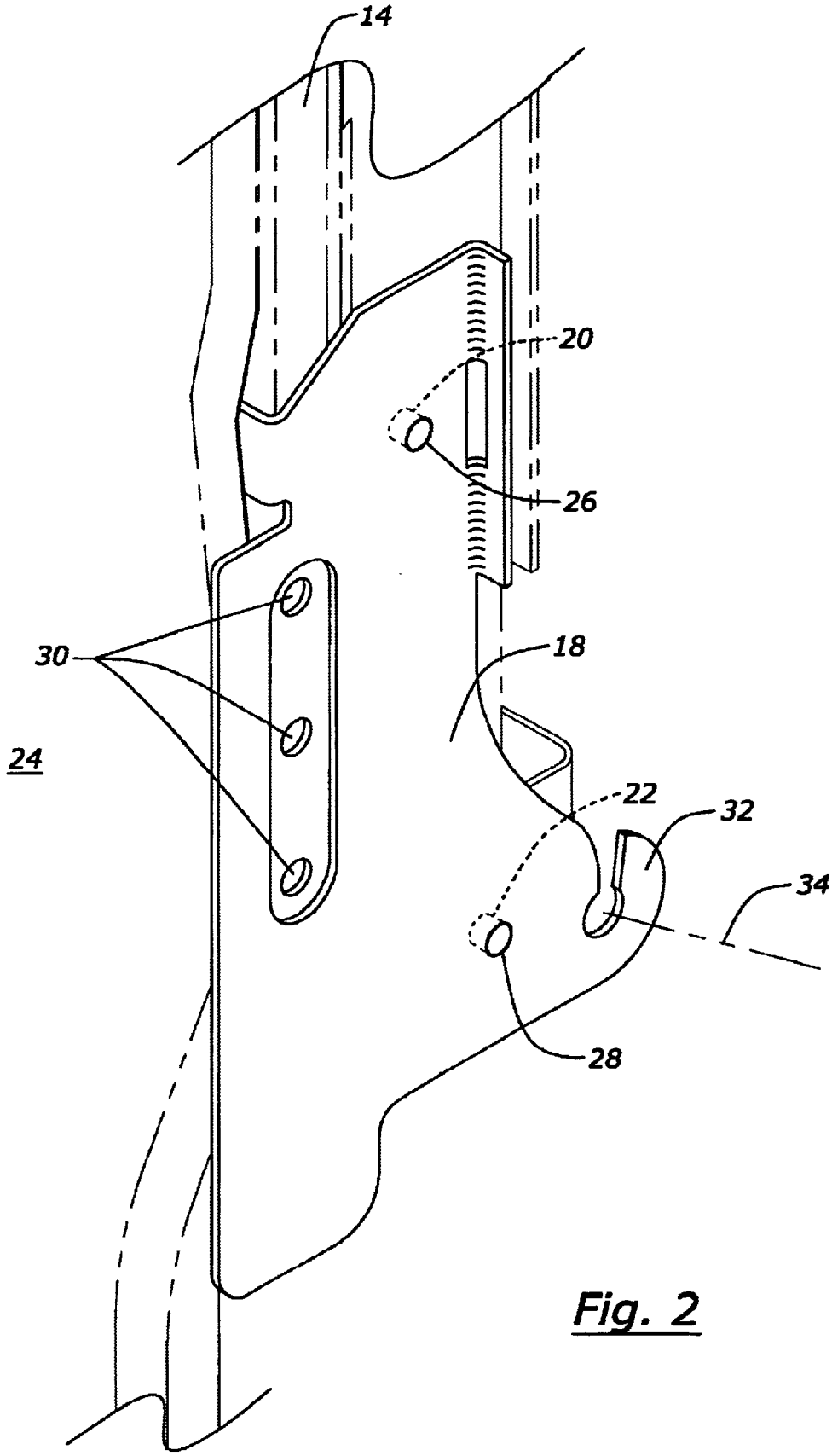
FIG. 2 is an enlarged perspective view showing the door hinge for the dishwasher, with the door removed for clarity.

A dishwasher is generally designated in the drawings by the reference numeral 10. The dishwasher includes a tub 12, frame or collar 14, and a door 16. The frame 14 is U-shaped and extends around the tub 12 to support the tub 12 above a floor. The frame 14 also provides structural rigidity to the tub 12, which preferably is made of a lightweight plastic material. The door 16 of the dishwasher 10 is pivotally mounted to the frame 14 using hinges 18 on each side of the door 16. Accurate positioning of the hinges 18 is critical to assure proper sealing of the door 16 in the closed position over the front opening of the tub 12.

Figure 3:
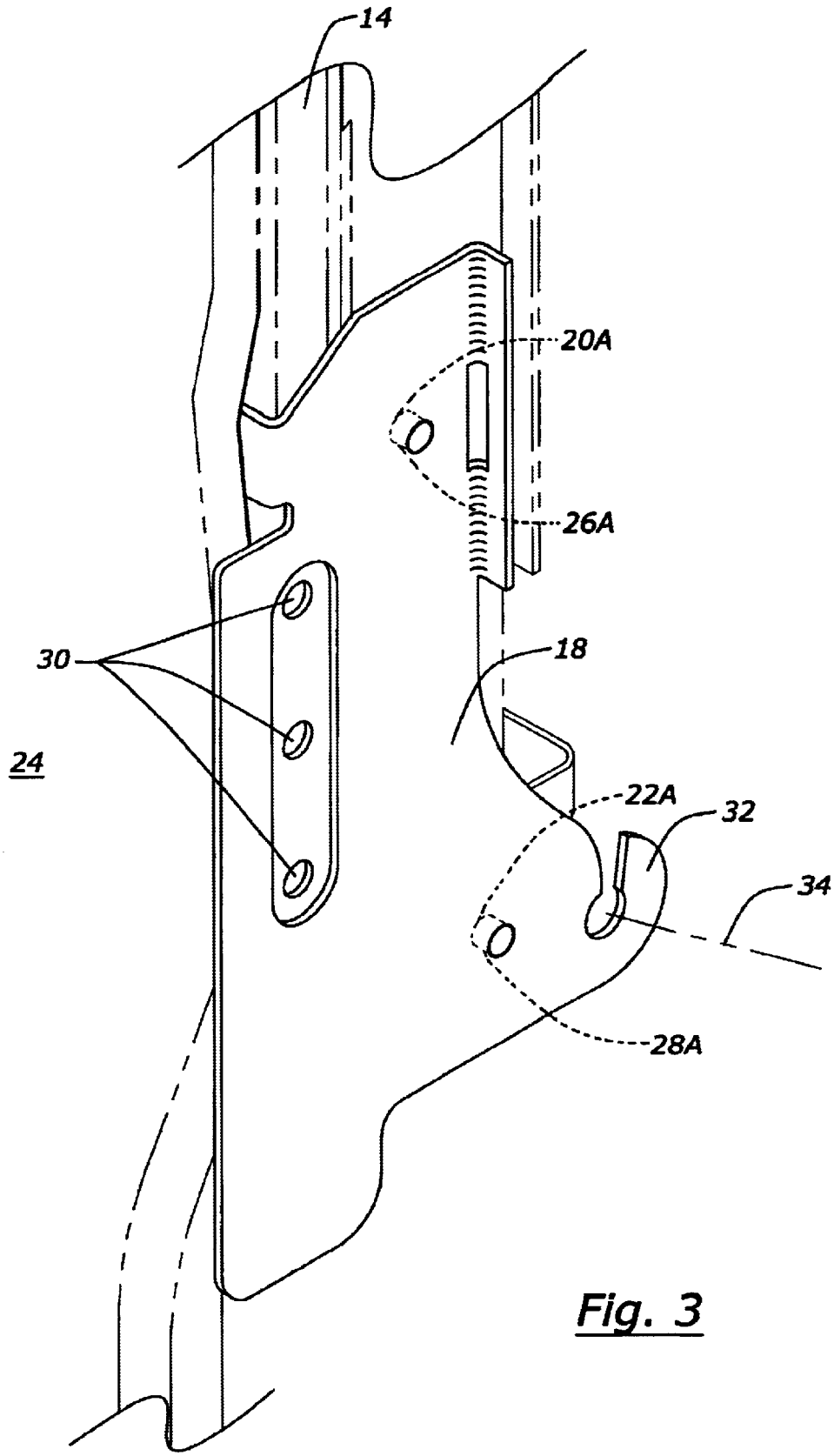
FIG. 3 is a view similar to FIG. 2 showing an alternative embodiment.

The present invention is directed towards a method and means for accurately positioning the hinges 18 for securement to the frame 14. More particularly, a pair of spaced apart bosses 20, 22 are formed on the sides 24 of the tub 12. Each hinge 18 has upper and lower recesses or holes 26, 28 which are adapted to receive the bosses 20, 22. It is also envisioned that, alternatively, as shown in FIG. 3, the hinges 18 can include bosses 26A, 28A or formed dimples that would be received by molded recesses 20A, 22A formed in the sides of the tub 12. Also, the tub 12 could include a recess and a boss with the hinge 18 having a mating boss and recess. Thus, the bosses 20, 22 or 26A, 28A locate or position the hinges 18, which can then be fixed to the frame 14. A series of holes 30 are provided on the hinge 18 through which self-drilling screws may extend for attaching the hinges 18 to the frame 14. Alternatively, the hinges 18 can be welded to the frame 14. Alternatively, the holes 30 may be slotted and screws used to secure the hinge 18 to the frame 14.

The hinges 18 includes a lower arm or hook 32 which define the pivot axis 34 for the door 16. The hooks 32 are adapted to receive a pin or axle (not shown) on the door 16, such that the door can pivot between the horizontal open position and the vertical closed position.

According to the method of the present invention, the hinges 18 are located on the tub 12 by positioning the holes 26, 28 over the bosses 20, 22, and then fixing the hinges 18 to the frame 14. It is understood that a single boss or multiple bosses may be provided on the sides of the tub 12 for aligning the hinges 18 both horizontally and vertically before fixing the hinges 18 to the frame 14.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. An improved dishwasher having a tub, a frame extended around the tub, a door, and a pair of hinges secured to the frame on opposite sides of the tub for pivotally connecting the door to the tub, the improvement comprising:

at least one boss on each side of the tub; and a recess in each hinge adapted to receive the boss so as to locate the hinge relative to the tub.

2. The improved dishwasher of claim 1 wherein two bosses are provided on each side of the tub and two recesses are provided in each hinge for receiving the bosses.

3. The improved dishwasher of claim 2 wherein the bosses are vertically spaced from one another.

4. The improved dishwasher of claim 1 wherein the boss locates the hinge both vertically and horizontally.

5. A method of locating a dishwasher door hinge on a dishwasher tub so as to accurately mount the door to the tub, comprising:

positioning an aperture in the hinge over a boss on the tub so that the boss is received in the aperture; and then fixing the hinge to a frame extending around the tub.

6. The method of claim 5 further comprising positioning a second aperture in the hinge over a second boss in the tub before fixing the hinge to the frame.

7. The method of claim 5 wherein positioning the hinge on the tub locates the hinges both vertically and horizontally.

8. An improved dishwasher having a tub, a frame extended around the tub, a door, and a pair of hinges secured to the frame on opposite sides of the tub for pivotally connecting the door to the tub, the improvement comprising:

at least one boss on each hinge; and a recess in each side of the tub adapted to receive the boss so as to locate the hinge relative to the tub.

9. The improved dishwasher of claim 8 wherein two bosses are provided on each hinge and two recesses are provided in each side of the tub for receiving the bosses.

10. The improved dishwasher of claim 9 wherein the bosses are vertically spaced from one another.

11. The improved dishwasher of claim 8 wherein the boss locates the hinge both vertically and horizontally.

* * * * *